US005160510A

United States Patent [19]

Steinbacher et al.

[11] Patent Number: 5,160,510

[45] **Date of Patent: * Nov. 3, 1992**

[54] PROCESS AND APPARATUS FOR PURIFYING DUST- AND POLLUTANT-CONTAINING EXHAUST GASES

[75] Inventors: Karl Steinbacher, Mühlheim; Hermann Schmidt, Bad Nauheim; Wilhelm Leussler, Frankfurt, all of Fed. Rep. of Germany

[73] Assignee: Metallgesellschaft Aktiengesellschaft, Frankfurt am Main, Fed. Rep. of Germany

[ * ] Notice: The portion of the term of this patent subsequent to Aug. 11, 2009 has been disclaimed.

[21] Appl. No.: 710,354

[22] Filed: Mar. 31, 1991

[30] Foreign Application Priority Data

Jun. 9, 1990 [DE] Fed. Rep. of Germany ..... 4018488
Jul. 26, 1990 [DE] Fed. Rep. of Germany ..... 4023723

[51] Int. Cl.[5] ..... B03C 3/00
[52] U.S. Cl. ..... 55/7; 55/10; 55/12; 55/119; 55/122; 55/112
[58] Field of Search ..... 55/6, 7, 10, 12, 124, 55/112, 126, 119, 122

[56] References Cited

U.S. PATENT DOCUMENTS

| | | | |
|---|---|---|---|
| 2,708,008 | 5/1955 | Hedberg et al. | 55/126 |
| 2,709,497 | 5/1955 | Phyl | 55/119 |
| 3,238,702 | 3/1966 | Seversky | 55/120 |
| 3,444,668 | 5/1969 | Masuda | 55/126 |
| 4,529,418 | 7/1985 | Reif et al. | 55/119 |

FOREIGN PATENT DOCUMENTS

| | | | |
|---|---|---|---|
| 114874 | 7/1979 | Japan | 55/10 |
| 61946 | 5/1980 | Japan | 55/10 |

*Primary Examiner*—Bernard Nozick
*Attorney, Agent, or Firm*—Michael J. Striker

[57] ABSTRACT

A process and apparatus are used for purifying dust- and pollutant-containing exhaust gases, which are first subjected in a first stage to a dry purification in a mass separator and are subsequently subjected in a second stage to an electrostatic purification in an electrostatic precipitator. In the second stage the exhaust gases are passed through one or more fields provided with liquid-wetted collecting electrodes, which define gas passages. The electrostatic precipitator also has an overflow trough and a collecting trough for each collecting electrode. Liquid supplied to the overflow trough flows onto the collecting electrode and then is collected in the collecting trough.

25 Claims, 6 Drawing Sheets

Fig.10
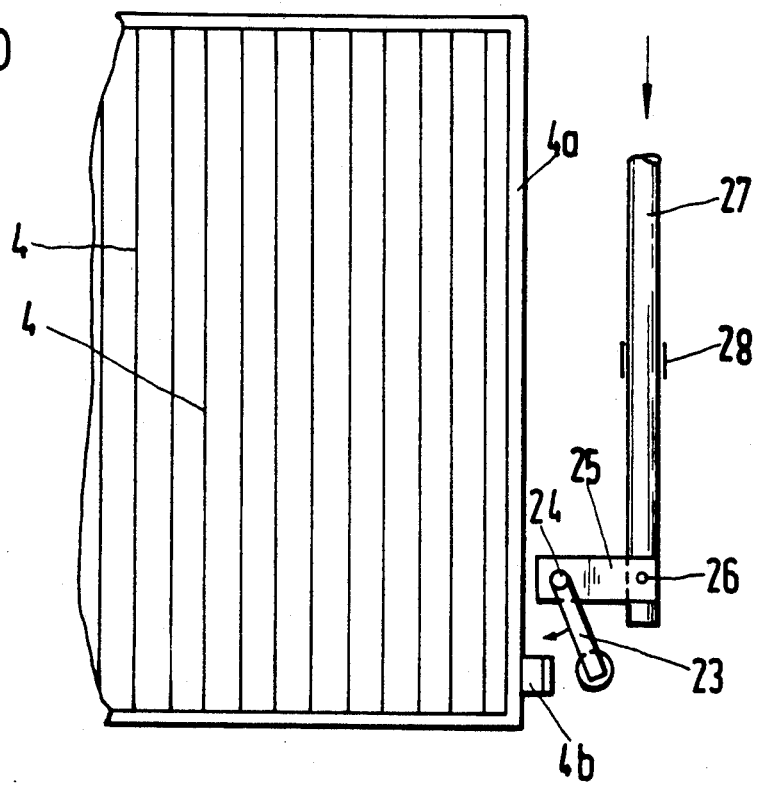
Fig.11
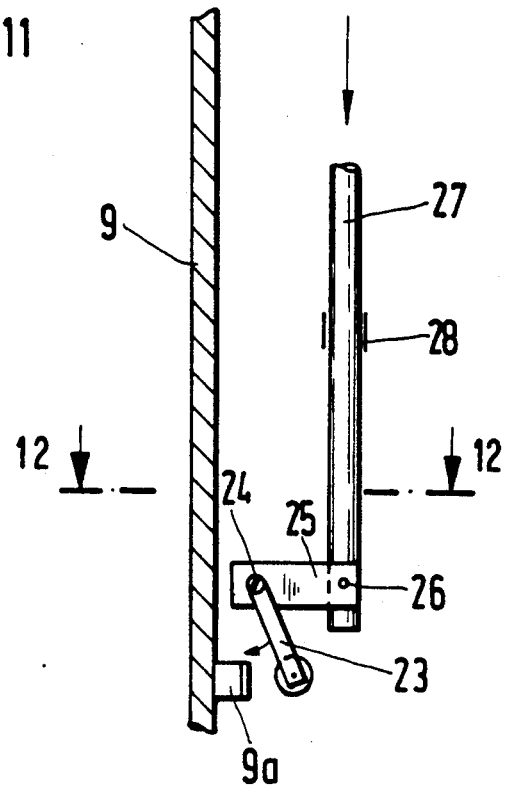
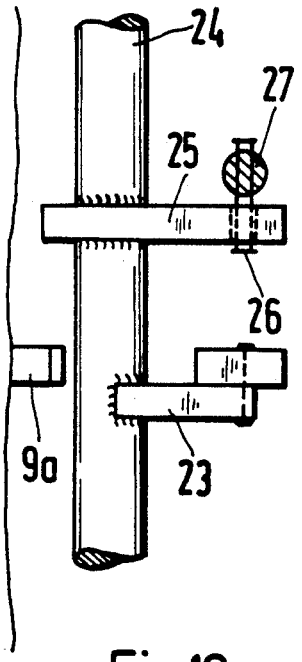
Fig.12

PROCESS AND APPARATUS FOR PURIFYING DUST- AND POLLUTANT-CONTAINING EXHAUST GASES

BACKGROUND OF THE INVENTION

This invention relates to a process of purifying dust- and pollutant-containing exhaust gases, which are first subjected in a first stage to a dry purification in a centrifugal separator and are subsequently subjected in a second stage to an electrostatic purification in an electrostatic precipitator. The invention relates also to an apparatus for carrying out the process.

Processes in which dust-containing exhaust gases are purified by subjecting the exhaust gases in a first process step to a dry purification in a centrifugal and subsequently subjecting the exhaust gases in a second process step to a dry electrostatic purification in an electrostatic precipitator are known. Published German Application 2907081 describes an apparatus for removing dust from exhaust gas under dry conditions. That apparatus consists of a centrifugal separator having numerous dedusting cells and succeeded by a dry-process electrostatic precipitator, which is horizontally flown through. The object of the invention described in Published German Application 2907081 is that the centrifugal separator should be simple and compact and should be so designed that it precedes the electrostatic precipitator without difficulty. But the apparatus described in Published German Application 2907081 has the disadvantages that the exhaust gases can only be dedusted in the apparatus, but other polluants contained in the exhaust gas remain therein.

SUMMARY OF THE INVENTION

For this reason it is an object of the invention to provide for the purification of dust- and pollutant-containing exhaust gases a process in which the exhaust gases are first subject in a first stage to a dry purification in a centrifugal separator and are subsequently subjected in a second stage to an electrostatic purification in an electrostatic precipitator and in which dust as well as pollutants are removed from the exhaust gases. Another object of the invention is to provide an apparatus for carrying out the process.

The object underlying the invention is accomplished in that the exhaust gases are passed in the second stage through one or more fields provided with liquid-wetted collecting electrodes, which define gas passages. The term "dust" refers to the solid particles contained in the exhaust gas. For instance, in sintering plants the dust consists mainly of iron oxide-containing solid particles and in fuel-firing plants the dust consists mainly of fine ash particles. The term "pollutants" relates to the acid components which are contained in the exhaust gas, such as HF, $SO_2$, $SO_3$ and HCl, and to the nonferrous metals, such as Pb, Cd, Hg, and As, which are contained in the exhaust gas as a vapor or gas or in a sublimed form. The centrifugal separators which may be employed include cyclones or multicyclones. The collecting electrodes may consist of metal plates, metal nets, plastic woven fabrics, or slabs of ceramic materials. The liquid which is supplied to the collecting electrodes in the second stage is an aqueous solution. In case of an exhaust gas flow rate of 100,000 $m^3/h$ the field strength should be, e.g., 1.5 to 5 KV/cm and the collecting surface area of the collecting electrodes is in the range from 200 to 800 $m^2$. It has surprisingly been found that in the process in accordance with the invention a removal of dust and pollutants will be effected to such a degree that the concentrations of dust and pollutants in the pure gas will be below the limits specified in TA Luft (German technical instruction for air pollution control) dated Feb. 27, 1986.

According to a preferred feature of the invention the liquid is supplied in the second stage to the top ends of the collecting electrodes and is collected directly under the bottom ends of the collecting electrodes and is laterally discharged from the precipitator and the substantially dry dust which is still separated in the second stage is received by a dust-collecting device. The dust-collecting devices which may be employed include various devices, such as dust bins, dust-collecting troughs and discharge means, such as screw conveyors. A predominating part of the dust is removed in a dry state in the first stage and the dust which enters the second stage may also be removed in a substantially dry state and can thus be separated from the pollutants. One advantage of the present invention is that there is no formation of sludge in the second stage, which sludge would contain a large amount of pollutants in addition to the dust and would have to be aftertreated. The formation of sludge is avoided because only the collecting electrodes are wetted and the liquid flowing on the collecting electrodes is drained in collecting troughs disposed directly under the collecting electrodes, while the gas passages proper and the space below the electrodes remains dry.

German Patent Application P 39 28 808 describes for the electrostatic purification of dust- and pollutant-containing exhaust gases in multistage electrostatic precipitators a process in which the exhaust gases are subjected in a firststage to a dry electrostatic purification and the pollutants are subsequently removed from the exhaust gases in a second electrostatic stage, in which liquid-wetted collecting electrodes are provided. In that process the liquid which has been supplied is collected directly under the bottom ends of the collecting electrodes and is laterally discharged from the precipitator and the substantially dry dust which is still separated in the second stage is received by a dust-collecting device. But it has surprisingly been found that it is also possible to separately remove dry dust, on the one hand, and pollutants, on the other hand, if the first stage consists of a centrifugal separator rather than of a dry electrostatic precipitator so that a pollutantladen sludge which could be disposed of only with difficulty is also not formed in the second stage of the process in accordance with the invention.

According to a preferred feature of the invention the residence time of the exhaust gases in the second stage amounts to 2 to 6 seconds. As a result, the gas is subjected in the second stage to a temperature drop which is only approximately as large as the temperature rise to which the gas is subjected as it is compressed by the succeeding fan. At the same time, the dew point temperature of water is raised only by 4° C. so that the difference between the gas temperature and the dew point temperature of the water in the second stage is so large that the temperature does not decrease below the dew point temperature of the water and as a result, no acid pollutants condense on the non-wetted, dry surfaces in the second stage. For this reason there is no need for special measures for avoiding a corrosion in the second stage. If the residence time of the exhaust gases in the second stage is 2 to 6 seconds, the coarse particle size fraction of the dust is collected in the first stage and the fine particle size fraction of the dust is collected in the second stage. For this reason the process can successfully be carried out at low gas velocities and the residence time in the second stage is sufficient for a removal of the polluants from the exhaust gas to a sufficiently high degree.

A further preferred feature of the invention resides in that the liquid which is employed consists of an alkaline aqueous solution having a pH value of 7 to 9. If such a solution is employed the acid pollutants are bound at a relatively high rate so that the pure gas discharged from the second stage is almost free of acid pollutants.

According to a further feature of the invention, NaOH and/or KOH and/or $Ca(OH)_2$ is added to the liquid. These substances are easily soluble in water so that the aqueous solution can quickly and easily be adjusted to a pH value in the range from 7 to 9.

According to a further preferred feature of the invention the corona discharge system of the second stage and/or the housing wall of the second stage are rapped. It has surprisingly been found that a major share of the dust which has been detached by the rapping is not deposited on the liquid-wetted collecting electrodes but will fall down in an agglomerated form in part in the dry gas passage space or in direct contact with the housing walls of the second stage so that the dust will directly be received by the dust-collecting device. The rapping is not restricted to the use of a specific rapping mechanism.

According to a further feature of the invention the corona discharge system is rapped once in each interval of time of 2 to 20 minutes. The term "minutes" relates to the time for which the second stage is energized. If the corona discharge system is rapped once in each interval of time of 2 to 20 minutes, the corona discharge system will thoroughly be cleaned but the electrostatic purification proper carried out in the second stage will not adversely be affected.

According to a further preferred feature of the invention the dead space between the collecting electrodes and the housing wall in the second stage is purged with hot gas. The hot gas enters the dead space through nozzles. In this way, a condensation of the water vapor contained in the exhaust gas on the walls owing to a temperature drop below the dew point temperature and a resulting corrosion of the structural parts of the second stage can be avoided.

According to a further feature of the invention a part of the pure gas which is discharged from the second stage is used as the hot gas. That measure guarantees that the purging of the dead space does not cause pollutants to return to the second stage. The injected pure gas is substantially free of pollutants so that a corrosion, particularly on the housing walls of the multistage separator, is almost entirely avoided.

The object underlying the invention is also accomplished by the provision of an apparatus which serves to carry out the process and which comprises a centrifugal separator, which constitutes the first stage, and an electrostatic precipitator, which constitutes the second stage and which contains liquid-wetted collecting electrodes, which define gas passages. That apparatus can be operated at low gas velocities to remove dust and pollutants from the exhaust gas to such a high degree that the concentrations of dust and pollutant will be below the prescribed limits.

According to a further feature of the invention, an overflow trough is provided at the top end of each collecting electrode, a collecting trough is provided at the bottom end of each collecting electrode, and each collecting electrode is secured to the bottom of the associated overflow trough. That design results in a uniform flow of liquid on the collecting electrodes and ensures that the pollutantladen liquid is collected directly under the bottom ends of the collecting electrodes substantially without an ingress of dust and is subsequently discharged. The collecting troughs are so dimensioned that they can take up the liquid at the liquid supply rate, which in case of an exhaust gas rate of 100,000 $m^3/h$ amount to 40 to 80 $m^3/h$, as a rule. The overflow troughs are so dimensioned that the collecting electrodes are uniformly wetted with a film of liquid. If the collecting electrodes of the second stage are secured to the bottom of the associated overflow troughs, a uniform wetting of the collecting electrodes from their top end is effected.

According to a further feature of the invention at least one edge of each overflow trough is comblike or serrated. This will ensure that the collecting electrodes are uniformly wetted by a film of liquid and that the thickness of the film of liquid is approximately constant throughout the collecting surface area of a given collecting electrode. This result permits a uniform separation of the pollutants in the second stage, almost the entire surface area of the collecting electrodes is available for the separation of the pollutants, and an overdimensioning of the surface areas of the several collecting electrodes is reliably avoided.

According to a further feature of the invention, a liquid-distributing pipe which is connected to the liquid supply line and is formed with orifices is contained in each overflow trough. With that arrangement the liquid can be supplied to each overflow trough directly from above. That arrangement also permits a recirculation of the liquid.

According to a further feature of the invention each overflow trough is connected to the associated liquid-distributing pipe. As a result, each collecting electrode is directly connected to the associated liquid-distributing pipe by the associated overflow trough so that the collecting electrode is easily accessible for repairs.

According to a further feature of the invention a pipe is provided at the top end of each collecting electrode of the second stage and is directly joined to that collecting electrode. The pipe is provided on that side which faces away from the collecting electrode with bores lying in the plane of the collecting electrode and communicates with the liquid supply line, and a collecting trough is provided at the bottom end of each collecting electrode of the second stage. That pipe may be joined to the collecting electrode, e.g., by welding or adhesive bonding or by a screw joint or rivet joint. It has surprisingly been found that the discharge of liquid through the bores does not result in a crystallization at the bores so that a uniform flow on the collecting electrodes is guaranteed for a long operating time. In the apparatus according in accodance with the invention it is also possible to optimize the thickness of the liquid film by a change of the liquid supply rate. It may also be desirable to change the liquid flow rate in accordance with a predetermined cycle during a continuous supply of the liquid.

A further feature of the invention resides in that the bores are 8 to 12 mm in diameter. This results in a particularly uniform distribution of the liquid on each collecting electrode.

According to a further feature of the invention the bores are 20 to 40 mm spaced apart. With a bore spacing of 20 to 40 mm the thickness of the film of liquid on the collecting electrode can be adjusted in a particularly desirable manner because a liquid film having a constant thickness will already be formed on the outside surface of the pipe.

A further feature of the invention resides in that the pipe is 60 to 140 mm in diameter. If such pipe is used, liquid can easily be supplied to the collecting electrodes at the usual flow rates, which amounts to 40 to 80 $m^3/h$ if the exhaust gas rate amounts to 100,000 $m^3/h$. A pipe which is 60 to 140 mm in diameter can be used for numerous purposes so that the costs of the apparatus in accordance with the invention are decreased by a series production of the pipe.

According to a further feature of the invention the pipe is additionally connected to the collecting electrode by at least one plate extending in the longitudinal direction of the pipe. This has the result that the flow of liquid does not break down between the bores of the pipe and the collecting electrode and that the connection between the pipe and the collecting electrode is reinforced. Each plate may be joined to the pipe and to the collecting electrode e.g., by welding or adhesive bonding or by a screw joint or rivet joint.

According to a further feature of the invention at least one plate extending tangentially to the pipe is joined to the pipe. This results in a continuous transfer of the film of liquid between the pipe and the plate.

According to a further feature of the invention the second stage has a hot gas supply line. The provision of a hot gas supply line in the second stage permits a purging of the dead space between the collecting electrodes and the housing wall of the precipitator of the second stage with hot gas.

According to a further feature of the invention the edges of each collecting electrode of the second stage are joined to piping, which communicates with the liquid supply line. This provides the advantage that the liquid can directly be supplied to each collecting electrode and the gas passages between the collecting electrodes are kept free for the flow of gas so that the separation effected in the second stage of the multistage separator is not restricted.

According to a further feature of the invention the piping provided at the bottom edge of each collecting electrode is formed with orifices. This provides the advantage that liquid is directly injected also into the collecting troughs so that the collecting troughs are cleaned as the process is carried out and a discharge of the pollutant-laden liwuid out of the collecting troughs is thus guranteed. The orifices are so designed that the liquid may optionally be recirculated and even in that case a clogging of the openings by previously laden liquid is avoided.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 10 shows corona discharge electrodes of the second stage as well as a rapping mechanism.

FIG. 11 is a sectional view showing the housing wall of the second stage as well as a rapping mechanism.

FIG. 12 is a horizontal sectional view on the plane A—A in FIG. 11 and shows the rapping mechanism.

DESCRIPTION OF THE PREFERRED EMBODIMENTS

Figure 1:
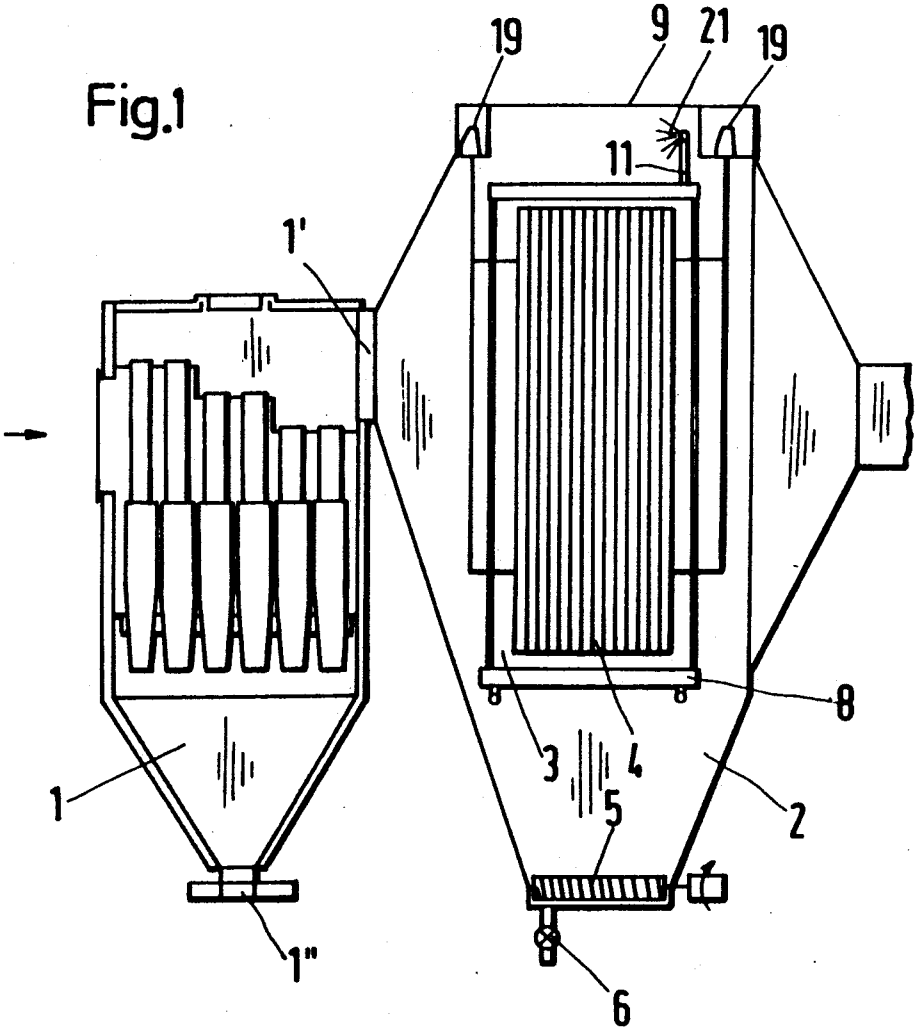
FIG. 1 is a longitudinal sectional view showing the centrifugal separator, which constitutes the first stage, and the electrostatic precipitator, which constitutes the second stage.

FIG. 1 is a longitudinal sectional view showing the centrifugal separator, which constitutes the first stage 1, and the electrostatic precipitator, which constitutes the second stage 2. The exhaust gas laden with dust and pollutants enters horizontally in the direction indicated by an arrow the first stage 1, in which a dry purification is effected in a mass separator. The illustrated centrifugal separator consists of a multicyclone. The dry dust which has been separated from the exhaust gas in the second stage 1 is collected in the funnel-shaped bottom part of the centrifugal separator and is removed through a lock chamber 1''. Immediately after its dry purification the exhaust gas enters the second stage 12 through the lock chamber 1'. The second stage 2 comprises liquid-wetted collecting electrodes 3 and corona electrodes 4, which are electrically insulated by pin insulators 19. The pollutant-laden liquid runs down on the collecting electrode surfaces and is received by the associated collecting troughs 8. The dry dust which has been separated in the second stage 2 is collected by a dust-collecting device 5 and discharged by a discharge device 6. The second stage 2 has a hot gas supply line 11. The hot gas 21 is injected through the nozzles of the hot gas supply line 11 into the dead spaces between the collecting electrodes 3 and the housing wall 9 of the second stage 2. Pure gas is horizontally discharged from the second stage 2 in the direction indicated by an arrow.

Figure 2:
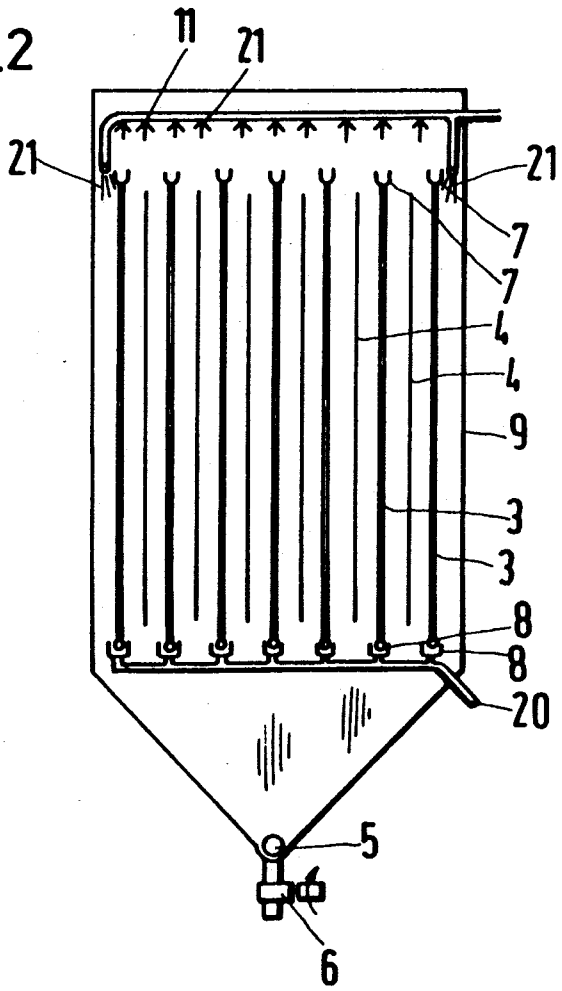
FIG. 2 is a transverse sectional view showing the second stage of the multistage separator.

FIG. 2 is a transverse sectional view showing the second stage 2 of the multistage separator with the collecting electrodes 3, the corona electrodes 4 as well as overflow troughs 7, collecting troughs 8 and the hot gas supply line 11. In accordance with FIG. 2 the dust collecting device 5 consists of a discharge screw, by which the dry dust separated in the second stage 2 is transported to a discharge device 6. The pollutant-laden liquid which has been collected in the collecting troughs 8 is laterally discharged through a drain 20. By means of the drain 20, the laden liquid, which contains dissolved salts, can be supplied to a succeeding crystallizing plant, in which the dissolved salts are recovered as solids.

Figure 3:
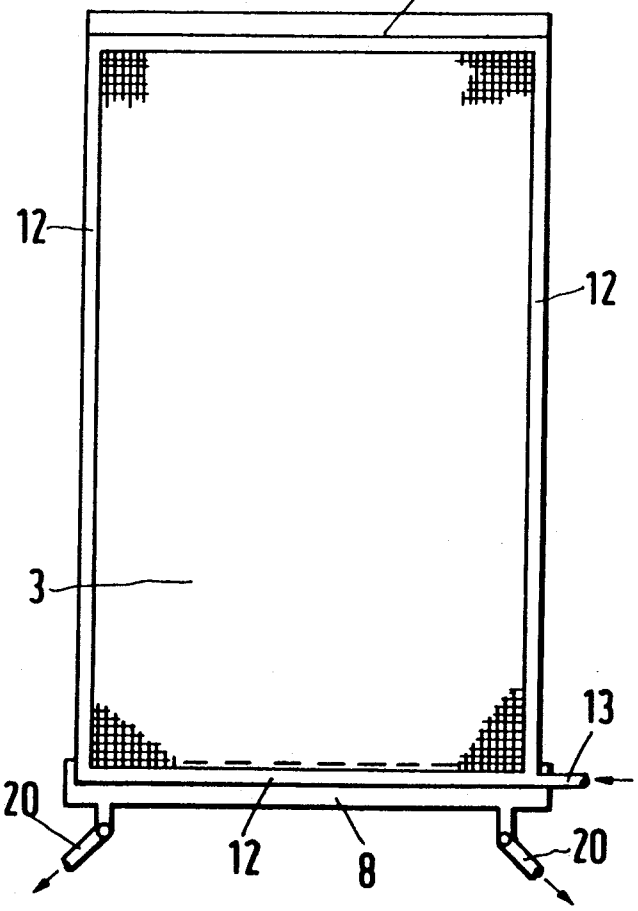
FIG. 3 shows a collecting electrode, which is joined at its edges to a piping, and shows also a liquid supply line and collecting trough.

FIG. 3 shows a wetted collecting electrode 3 provided with a liquid supply line 13 and the collecting trough 8. The liquid flows from the liquid supply line 13 through the piping 12 to the overflow trough 7 and flows from there on the surface of the collecting electrodes 3 into the collecting trough 8. The laden liquid is discharged through the drain 20.

Figure 4:
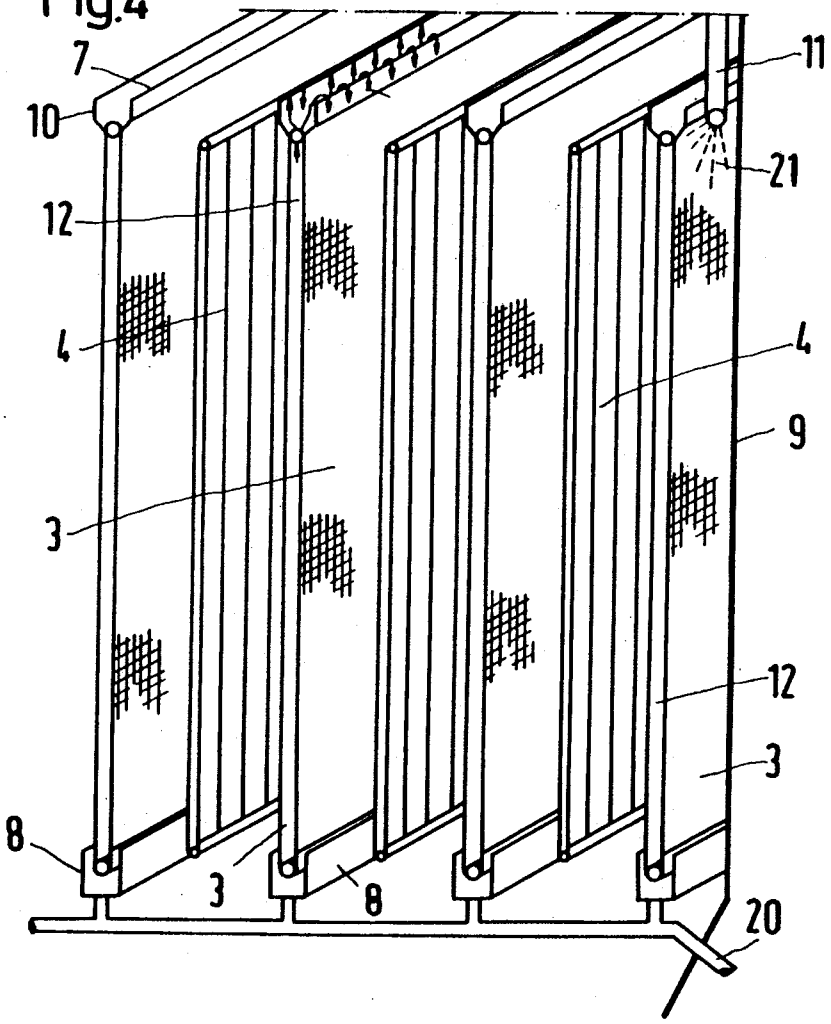
FIG. 4 is a fragmentary perspective view showing some gas passages of the second stage of the multistage separator.

FIG. 4 is a fragmentary perspective view showing some gas passages provided between the collecting electrodes 3 and shows also the hot gas supply line 11, overflow troughs 7 and collecting troughs 8. The liquid is supplied by the piping 12 to the overflow troughs 7 and flows over the edges 10 of each overflow trough 7 to the collecting electrode 3. The hot gas 21 is injected from the hot gas supply line 11 into the dead space between the collecting electrode 3 and the housing wall 9 of the separator.

Figure 7:
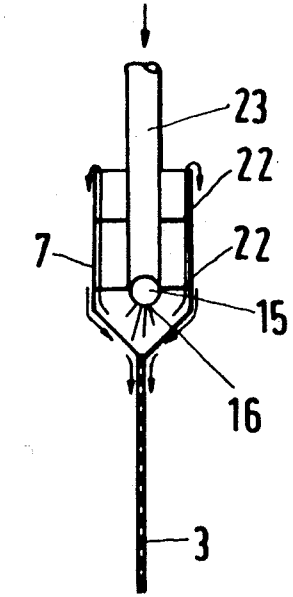
FIG. 7 is a transverse sectional view showing the top portion of a wetted collecting electrode, which is provided with an overflow trough, a liquid-distributing pipe and a liquid supply line.
Figure 6:
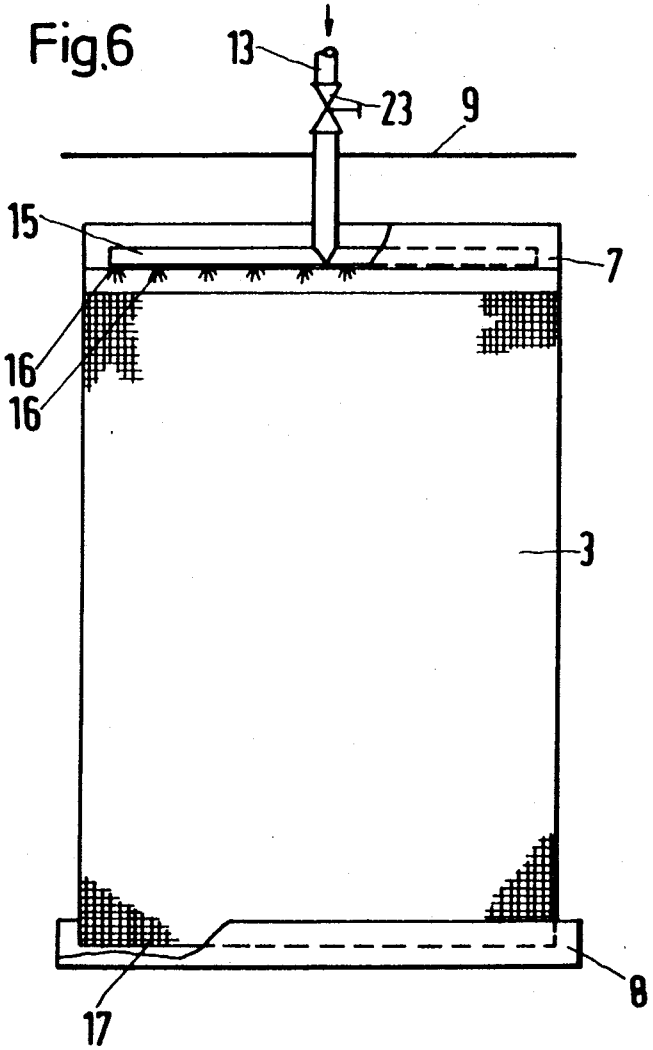
FIG. 6 is a side elevation showing the same collecting electrode as FIG. 5.
Figure 5:
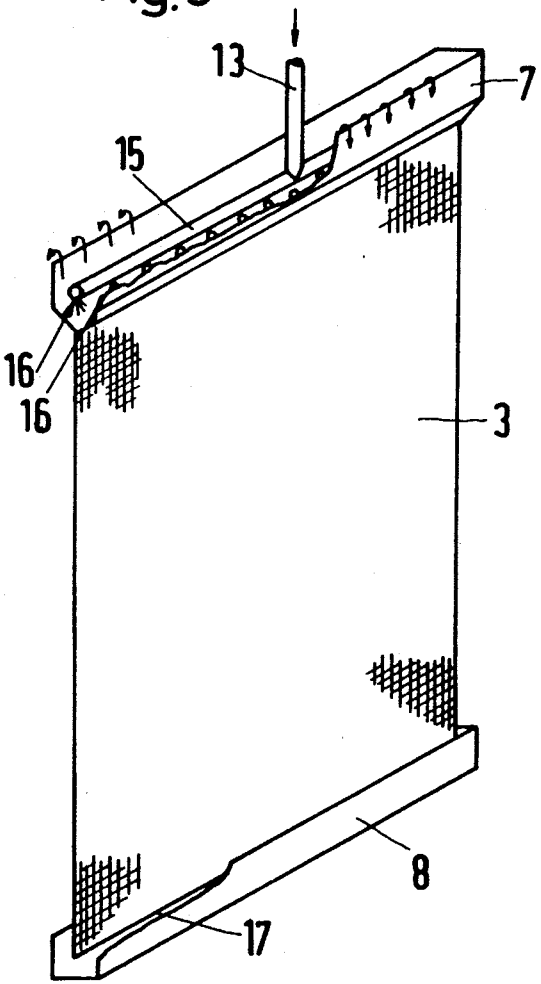
FIG. 5 is a perspective view showing a wetted collecting electrode, which is provided with an overflow trough and with a liquid-distributing pipe, which is formed with orifices and communicates with the liquid supply line.

FIGS. 5, 6, and 7 show a collecting electrode 3 provided with an overflow trough 7 and a collecting trough 8. Liquid is supplied from above to the overflow trough 7, which receives the liquid from a liquid-distributing pipe 15, which is formed with orifices 16 and communicates with the liquid supply line 13. The collecting electrode 3 is weighted by a weight 17 and can thus be held in a centered position in the collecting trough 8. FIG. 6 shows a valve 23, which is provided in the liquid supply line 13 outside the housing wall 9 of the separator and by which the rate of liquid can exactly be controlled. As is shown in FIG. 7 the liquid supply line 13 and the liquid-distributing pipe 15 are connected to the overflow trough 7 by webs 22 so that the collecting electrode 3 can be fixed by means of the overflow trough 7 to the liquid-distributing pipe 15 and the liquid supply line 13.

Figure 8A:
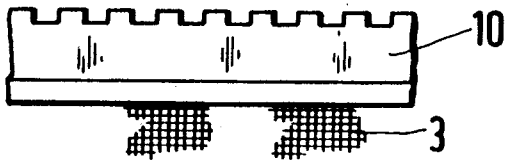
FIGS. 8*a*, 8*b*, 8*c* show various designs of overflow edges of the overflow troughs.
Figure 8B:
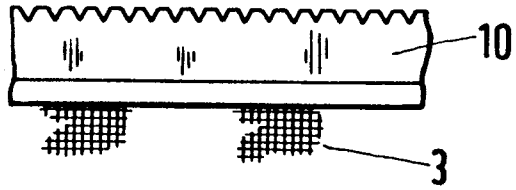
Figure 8C:
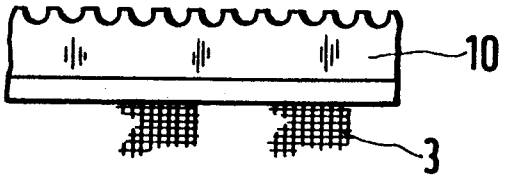

FIGS. 8*a*, 8*b*, and 8*c* show various embodiments designs of the edges 10 of the overflow troughs 7. Contrary to smooth edges, comblike or serrated edges permits a uniform supply of the liquid to the collecting electrode 3.

Figure 9:
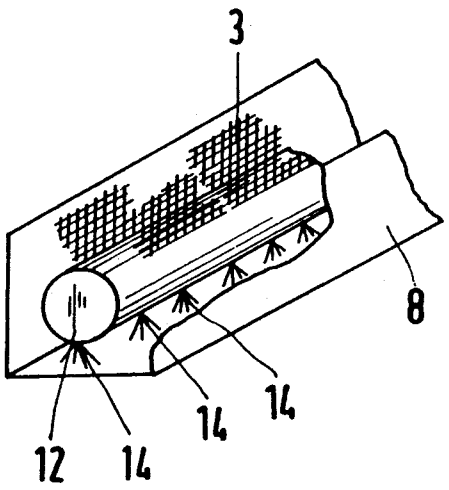
FIG. 9 is a fragmentary perspective view showing a collecting trough, which is provided with a piping that extends along the bottom edge of each collecting electrode.

FIG. 9 shows a collecting trough 8 and a part of the piping 12 provided at the bottom edge of a collecting electrode 3. Part of the liquid which is supplied flows through the orifices 14 directly into the collecting trough 8 and flushes the same. The unladen liquid is discharged out of the collecting trough 8 together with the laden liquid.

Corona electrodes 4 of the second stage 2 together with a rapping mechanism are schematically shown in FIG. 10. The corona electrodes may consist, e.g., of metal wires, metal strips or plastic fibers coated with electrically conductive materials. Each corona electrode 4 extends vertically in and is fixed to a frame 4*a*, which belongs to the suspending structure 18 and is provided with an anvil 4*b*. A striker 23 is fixed to a rotatably mounted shaft 24, to which a raising lever 25 is secured, which is pivoted at 26 to a pull rod 27. The pull rod 27 is vertically slidably mounted in the bearing 28. As the pull rod 27 moves in the direction indicated by an arrow, the striker 23, strikes against the anvil 4*b*.

FIG. 11 shows the housing wall 9 of the second stage 2 together with a rapping mechanism. The rapping mechanism is similar to the rapping mechanism shown in FIG. 10. As the pull rod 27 moves in the direction indicated by the arrow, the striker 23 strikes against the anvil 9*a*, which is secured to the housing wall 9.

FIG. 12 is a top plan view showing the rapping mechanism illustrated in FIG. 11. For the sake of clearness, the shaft 24 is shown on a larger scale in FIG. 12. The striker 23 is welded to the shaft 24 and the raising lever 25 is also welded to the shaft 24.

The rapping mechanism shown in FIGS. 10 to 12 represents only an example and other rapping mechanisms may be used.

Figure 13:
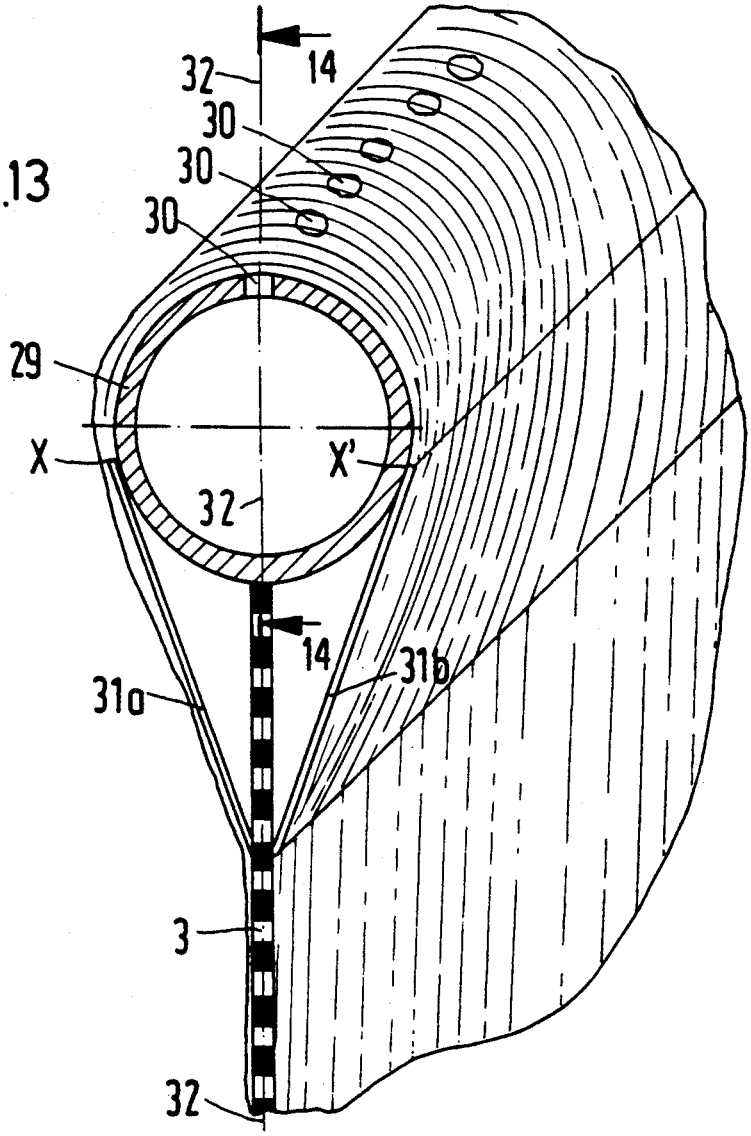
FIG. 13 is a sectional view showing a pipe which is connected to the collecting electrode.

FIG. 13 shows a pipe 29, which is joined to the collecting electrode 3 and on that side which faces away from the collecting electrode 3 has bores 30, which are disposed in the plane 32 of the collecting electrode 3. Through the bores 30 the liquid is discharged from the interior of the pipe. The pipe 29 is additionally connected to the collecting electrode 3 by plates 31*a* and 31*b*, which are tangential to the pipe 29 and are joined to the pipe 29 throughout its length at points X and X', respectively. The liquid which has been discharged through the bores 30 flows on the outside surface of the pipe 29 to the plates 31*a* and 31*b* to form a film of liquid having a constant thickness. The liquid flows on the plates 31*a* and 31*b* directly to the surface of the collecting electrode 3 and is drained from that surface.

Figure 14:
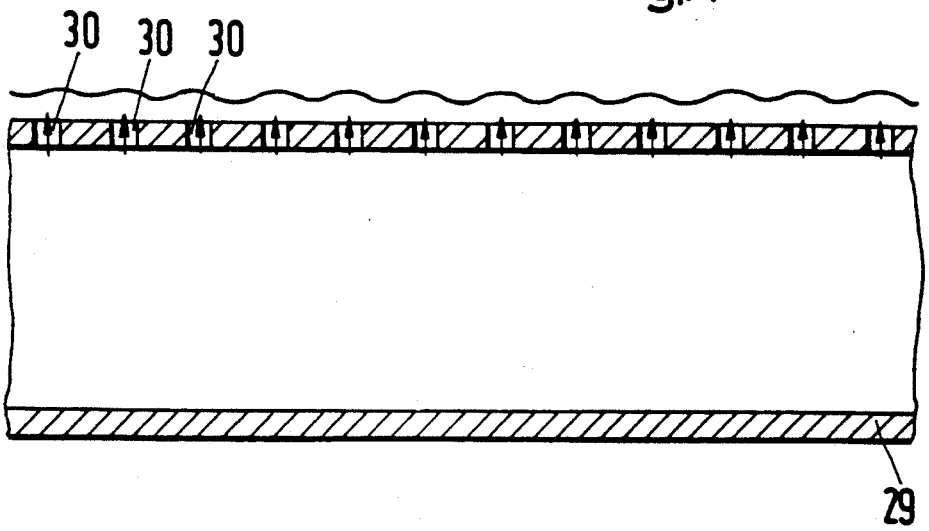
FIG. 14 is a sectional view taken on line B—B in FIG. 13 and showing the pipe.

FIG. 14 is a sectional view taken on line B—B of FIG. 13 on the pipe 29 in the plane 32 of the collecting electrode 3. The liquid is discharged in the direction indicated by an arrow through the bores 30 and forms on the outside surface of the pipe 29 a film of liquid having an almost constant thickness.

The invention will now be described more in detail with reference to an example.

A sintering belt conveyor produces exhaust gas at a rate of 400,000 $sm^3/h$ ($sm^3$=standard cubic meter). The exhaust gas has a temperature of 120° C., a dew point temperature of 40° C. and a dust content of 1.5 $g/sm^3$. The exhaust gas is horizontally fed to a multicyclone, which constitutes the first stage 1 and in which the gas is distributed to numerous parallel cyclones, which are contained in a common housing and are small in diameter but exert a strong centrifugal force. The multicyclone employed has the following separating efficiencies in percent for the various particle size fractions:

| Particle size Mm | Separation efficiency % |
|---|---|
| 0-2 | 0 |
| 2-5 | 50 |
| 5-10 | 80 |
| 10-15 | 93 |
| 15-20 | 95 |
| 20-30 | 97 |
| >30 | 99 |

The total separation efficiency of the multicyclone is 91.5%. As a result, the exhaust gas has a dust content of 0.128 g/sm$^3$ as it enters the electrostatic precipitator which constitutes the second stage 2. The liquid-wetted collecting electrodes 3 of the second stage 2 have a collecting surface area of 1500 m$^2$.

The liquid for wetting the collecting electrodes 3 is supplied at a rate of 300 m$^3$/m. At a field strength in the range from 1.5 to 5 kV/cm the exhaust gas treated in the electrostatic precipitator used as the second stage 2 had a measured content of ductlike substances amounting to 18 mg/sm$^3$. The emission of dustlike inorganic substances behind the second stage 2 amounted to less then 0.2 mg/sm$^3$ for class I substances (Cd, Hg, etc.), to less than 1.0 mg/sm$^3$ for class II substances (from As, Ni, etc.), and to less than 5.0 mg/sm$^3$ for class III substances (Pb, F, Sn, etc.) (classification of dustlike inorganic substances in TA-Luft dated Feb. 27, 1986). The limits for vaporous or gaseous inorganic substances—particularly the limit of 500 mg/sm$^3$ for $SO_2$—have not been exceeded.

The temperature drop along the wetted collecting electrodes 3 is about 25° C. so that the gas temperature decreases to 95° C. and the dew point temperature is raised to 44° C. In the succeeding fan the gas temperature is raised by 24° C. to 119° C. and gas at a temperature of 119° C. enters the chimney. Because in accordance with the invention the temperature drop of the exhaust gas in the second stage (2) is relatively small, the energy demand of the 3-megawatt fan will be reduced by about 120 kW if the gas entering the fan is at a temperature of 95° C. and has a dew point temperature of 44° C.

It will be understood that each of the elements described above, or two or more together, may also find a useful application in other types of methods and construction differing from the types described above.

While the invention has been illustrated and described as embodied in a process and apparatus for purifying dust- and pollutant-containing exhaust gases, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A process of purifying dust- and pollutant-containing exhaust gases, comprising the steps of first subjecting an exhaust gas in a first stage to a dry purification in a centrifugal separator after subjecting the exhaust gas to said dry purification in said first stage, subjecting the exhaust gas in a second stage to an electrostatic purification in an electrostatic precipitator and passing the exhaust gas in the second stage through at least one of a plurality of fields of said electrostatic precipitator, said fields of said electrostatic precipitator being provided with a plurality of liquid-wetted collecting electrodes, said liquid-wetted collecting electrodes defining a plurality of gas passages through which said exhaust gas can pass; and supplying a liquid in the second stage to top ends of the liquid-wetted collecting electrodes; collecting the liquid directly under bottom ends of the liquid-wetted collecting electrodes to form a collected liquid; discharging the collected liquid from the precipitator laterally; separating a dry dust in the second stage; and supplying the dry dust separated in the second stage to a dust-collecting device.

2. A process as defined in claim 1, and further comprising the step of operating the second stage with a residence time of the exhaust gas amounting to 2–6 seconds.

3. A process as defined in claim 1, wherein the liquid in the second stage consists of an alkaline aqueous solution having a pH value of 7 to 9.

4. A process as defined in claim 1, wherein the liquid contains a substance selected from the group consisting of NaOH, KOH and $Ca(OH)^2$.

5. A process as defined in claim 1; and further comprising the step of rapping a housing wall of the electrostatic precipitator.

6. A process as defined in claim 5, wherein said rapping includes rapping the housing wall of electrostatic precipitator once in each interval of time of 20–120 minutes.

7. A process as defined in claim 6; and further comprising the step of purging a dead space between the collecting electrodes and the housing wall of the second stage with a hot gas.

8. A process as defined in claim 7; and further comprising the steps of discharging a purified gas from the second stage and using a part of the purified gas discharged from the second stage as the hot gas.

9. A process as defined in claim 1; and further comprising the step of rapping a corona discharge system of the electrostatic precipitator.

10. A process as defined in claim 9; wherein said rapping includes rapping the corona discharge system once in each interval of time of 2–20 minutes.

11. A process as defined in claim 9, wherein said rapping includes consecutively rapping individual corona electrodes of the corona discharge system of the electrostatic precipitator.

12. as process as defined in claim 9, wherein said rapping includes consecutively rapping individual suspending structures of the corona discharge system associated with a gas passage.

13. An apparatus for purifying dust- and pollutant-containing exhaust gases, comprising a centrifugal separator for dry purification of an exhaust gas; and an electrostatic precipitator for electrostatic purification of the exhaust gas after passage through the centrifugal separator; said electrostatic precipitator comprising a plurality of discharge electrodes and liquid-wetted collecting electrodes defining a plurality of gas passages therebetween, said centrifugal separator being connected with said electrostatic precipitator so that said gas passages communicate with said centrifugal separator, means for supplying liquid to said liquid-wetted collecting electrodes, means for collecting the liquid from the liquid-wetted electrodes and means for collecting dry dust, said means for supplying liquid to the liquid-wetted electrodes including an overflow trough having a bottom associated with each of said collecting electrodes and said means for collecting said liquid including a collecting trough associated with each of said collecting electrodes.

14. An apparatus as defined in claim 13, wherein at least one edge of each of said overflow troughs is serrated.

15. A apparatus as defined in claim 13, wherein said means for supplying said liquid includes a liquid supply line and plurality of liquid-distributing pipes connected with said liquid supply line, each of said liquid-distributing pipes being provided with a plurality of orifices and being located in one of said overflow troughs.

16. An apparatus as defined in claim 13, wherein said electrostatic precipitator is provided with a hot gas supply line.

17. An apparatus as defined in claim 13; and further comprising a liquid distributing pipe connected with each of said overflow troughs.

18. An apparatus as defined in claim 13; wherein said means for supplying said liquid comprises a pipe provided at a top end of each of said liquid-wetted collecting electrodes and directly joined to said collecting electrode, said pipe being provided with a plurality of bores located substantially in a plane of said collecting electrode on a side of said pipe furthest from said collecting electrode, said pipe communicating with a liquid supply line; and wherein each of the collecting troughs is provided at a bottom end of each of said collecting electrodes and a top end of each of said collecting electrodes being secured to the bottom of an associated one of said overflow troughs.

19. An apparatus as defined in claim 18, wherein said bores are 8–12 mm in diameter.

20. An apparatus as defined in claim 18, wherein said bores are spaced 20–40 mm apart.

21. An apparatus as defined in claim 18, wherein said pipe is 60–140 mm in diameter.

22. An apparatus as defined in claim 18; and further comprising at least one plate extending in a longitudinal direction of said pipe and additionally connecting said pipe to said collecting electrode.

23. An apparatus as defined in claim 22, wherein said plate extends tangentially to said pipe and is joined to said pipe.

24. An apparatus as defined in claim 13, wherein said means for collecting said liquid has another liquid supply line for flushing each of said collecting troughs and a piping communicating with each of said other liquid supply lines, said collecting electrodes having edges joined to said piping.

25. An apparatus as defined in claim 24, wherein said piping is arranged at a bottom edge of each of said collecting electrodes and provided with orifices.

* * * * *